US009620314B2

(12) United States Patent
Lim

(10) Patent No.: US 9,620,314 B2
(45) Date of Patent: Apr. 11, 2017

(54) SUPPORTING STRUCTURE OF CLOSING RESISTOR UNIT FOR CIRCUIT BREAKER

(71) Applicant: LSIS CO., LTD., Anyang-si, Gyeonggi-do (KR)

(72) Inventor: Woo Seung Lim, Busan (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/803,957

(22) Filed: Jul. 20, 2015

(65) Prior Publication Data

US 2016/0042895 A1 Feb. 11, 2016

(30) Foreign Application Priority Data

Aug. 7, 2014 (KR) ..... 10-2014-0101818

(51) Int. Cl.
*H01H 31/02* (2006.01)
*H01H 33/16* (2006.01)
*H01H 85/42* (2006.01)

(52) U.S. Cl.
CPC ..... *H01H 31/02* (2013.01); *H01H 33/16* (2013.01); *H01H 33/168* (2013.01); *H01H 85/42* (2013.01)

(58) Field of Classification Search
CPC .... H01H 3/0213; H01H 33/16; H01H 33/166; H01H 33/168; H01H 31/02; H01H 50/534; H01H 85/42; H01H 9/42; H01H 33/70; H01H 33/91
USPC ..... 218/143
See application file for complete search history.

(56) References Cited

U.S. PATENT DOCUMENTS 3,745,284 A * 7/1973 Hosokawa ..... H01H 33/91 218/61
4,072,836 A 2/1978 Bischofberger et al.
4,293,749 A 10/1981 Kishi et al.
5,039,831 A * 8/1991 Sato ..... H01H 33/16 218/144
5,354,959 A 10/1994 Yoshizumi et al.
5,391,930 A * 2/1995 Ohshita ..... H01H 33/168 307/98

(Continued)

FOREIGN PATENT DOCUMENTS

JP 5517929 2/1980
JP 3274626 12/1991

(Continued)

OTHER PUBLICATIONS

European Patent Office Application Serial No. 15178594.6, Search Report dated Dec. 7, 2015, 6 pages.

(Continued)

*Primary Examiner* — Renee Luebke
*Assistant Examiner* — William Bolton
(74) *Attorney, Agent, or Firm* — Lee, Hong, Degerman, Kang & Waimey PC

(57) ABSTRACT

Disclosed is a supporting structure of a closing resistor unit for a circuit breaker which connects the closing resistor unit to the fixed portion through the first supporting plate and the second supporting plate to allow the closing resistor unit to move back and forth with respect to the fixed portion through the first supporting plate and to move up and down with respect to the fixed portion through the second supporting plate, whereby the closing resistor unit or its joints may be prevented from being damaged from impact.

4 Claims, 4 Drawing Sheets

(56) References Cited

U.S. PATENT DOCUMENTS 5,484,972 A * 1/1996 Tecchio ..... H02B 13/0356
218/70
5,567,924 A * 10/1996 Yano ..... H01H 33/166
218/143

FOREIGN PATENT DOCUMENTS

| | | |
|---|---|---|
| JP | 5258649 | 10/1993 |
| JP | 05-298965 | 11/1993 |

OTHER PUBLICATIONS

Japan Patent Office Application No. 2011-155815, Office Action dated Jun. 28, 2016, 1 page.

* cited by examiner

SUPPORTING STRUCTURE OF CLOSING RESISTOR UNIT FOR CIRCUIT BREAKER

CROSS-REFERENCE TO RELATED APPLICATION

Pursuant to 35 U.S.C. §119(a), this application claims the benefit of earlier filing date and right of priority to Korean Patent Application No. 10-2014-0101818, filed on Aug. 7, 2014, the contents of which is hereby incorporated by reference herein in its entirety.

BACKGROUND OF THE INVENTION

1. Field of the Invention

The present invention relates to a supporting structure of a closing resistor unit for a circuit breaker, and more particularly, to a supporting structure of a closing resistor unit for a circuit breaker, which improves the supporting structure of the closing resistor unit fixed to a fixed portion provided in the circuit breaker to stabilize the structure of the closing resistor unit and prolongs the lifespan of the circuit breaker.

2. Background of the Invention

A gas insulation switchgear is a switchgear that uses sulfur hexafluoride ($SF_6$) gas, commonly referred to as GIS.

The GIS may be miniaturized by encapsulating a circuit breaker efficient in extinction capability and stable in insulation, a switch, and a busbar connector, which are filled with $SF_6$ gas, in a sealed container, and its stability in use may be improved, whereby the GIS may be used in various fields.

For a circuit breaker provided in a large-scaled GIS that has a voltage supply of 170 kV or higher, a closing resistor unit is used to resist the overvoltage generated when a moving portion is inserted in to the fixed portion of the circuit breaker.

A circuit breaker based on a conventional closing resistor unit is shown in FIGS. 1 and 2.

As shown in FIGS. 1 and 2, the circuit breaker of a GIS used for 170 kV or higher voltage includes a moving portion 10, a fixed portion 20 into which the moving portion 10 is inserted and made contact, a closing resistor moving portion 30 provided with a closing resistor moving portion point of contact 31, a closing resistor unit 40 provided with a closing resistor unit point of contact 41 that contacts with the closing resistor moving portion point of contact 31.

At this time, the moving portion 10 is provided with a guide 10 formed to make a stable contact between a fixed point of contact 21*a* formed inside the fixed portion 20 and the moving portion 20. The guide 11 guides a rod 21 formed inside the fixed portion 20 into the inside of the moving portion 10, whereby the fixed point of contact 21*a* formed at the end of the rod 21 is in contact with the moving portion 10.

The contact of the closing resistor unit 40 of the conventional GIS described above is performed as follows.

First, if the moving portion 10 moves towards the fixed portion 20 in a state that the closing resistor unit 40 is attached to the side of the fixed portion 20, the rod 21 formed inside the fixed portion 20 is inserted into the moving portion 10.

At this time, since the fixed point of contact 21*a* is formed at the end of the rod 21, the fixed point of contact 21*a* may be guided by the guide 11 and thus inserted into the moving portion 10, thereby making contact with the moving portion 10.

Meanwhile, when the fixed point of contact 21*a* is in contact with the moving portion 10, a contact is generated between the closing resistor unit point of contact 41 and the closing resistor moving portion point of contact 31, whereby an impact is given to the closing resistor unit 40.

However, in the conventional circuit breaker described above, the impact generated by the contact between the closing resistor unit point of contact 41 and the closing resistor moving portion point of contact 31 is directly transferred to the closing resistor unit 40 or its neighboring instruments, whereby not only the closing resistor unit 40 but also the joints connected to the closing resistor unit 40 may be damaged, leading to a problem that structural stability of the closing resistor unit 40 inside the circuit breaker is remarkably deteriorated.

Also, since the structural stability of the closing resistor unit 40 inside the circuit breaker is remarkably deteriorated, another problem occurs in that the lifespan of the circuit breaker is greatly shortened.

Finally, other problem occurs in that attaching or detaching the closing resistor unit 40 to or from the fixed portion 20 is arduous.

SUMMARY OF THE INVENTION

Therefore, an object of the present invention devised to solve the aforementioned problems is to provide a supporting structure of a closing resistor unit for a circuit breaker, which improves the supporting structure of the closing resistor unit fixed to a fixed portion to stabilize the structure of the closing resistor unit and prolongs the lifespan of the circuit breaker.

To achieve these and other advantages and in accordance with the purpose of this specification, as embodied and broadly described herein, in a supporting structure of a closing resistor unit for a circuit breaker, the closing resistor unit being connected to a fixed portion of the circuit breaker provided in a gas insulation switchgear (GIS) to prevent a point of contact accident between a moving portion and the fixed portion, the supporting structure comprises a first supporting plate formed at a front upper end of the closing resistor unit, having one end rotatably connected to an upper end of the fixed portion at a predetermined angle back and forth and the other end rotatably connected to an upper end of the closing resistor unit at a predetermined angle back and forth; and a second supporting plate formed at a center of the closing resistor unit, having one end rotatably connected to a side of the fixed portion at a predetermined angle up and down and the other end connected to the closing resistor unit.

Also, the first supporting plate is provided with one or more first supporting plate fastening holes formed at both sides, the one end of the first supporting plate is rotated at a predetermined angle back and forth while connected to the fixed portion as a fastening member is fastened to the fixed portion and the closing resistor unit by passing through the first supporting plate fastening holes, and the other end of the first supporting plate is rotated at a predetermined angle back and forth while connected to the closing resistor unit.

Also, the second supporting plate is provided with a through hole, through which the closing resistor unit passes, formed at one side, and second one or more supporting plate fastening holes formed at the other side one, and the closing resistor unit is rotated at a predetermined angle up and down through the second supporting plate as the fastening member is fastened to the fixed portion through the second supporting plate fastening holes in a state that the closing resistor unit passes through the through hole.

Also, the fastening member is provided with a head formed at an upper portion, and the second supporting plate fastening holes are further provided with a head seating portion on which the head is seated.

As described above, the supporting structure of a closing resistor unit for a circuit breaker according to the present invention connects the closing resistor unit to the fixed portion through the first supporting plate and the second supporting plate to allow the closing resistor unit to move back and forth with respect to the fixed portion through the first supporting plate and to move up and down with respect to the fixed portion through the second supporting plate, whereby the closing resistor unit or its joints may be prevented from being damaged from impact.

Also, as the closing resistor unit or its joints may be prevented from being damaged from impact, structural stability of the closing resistor unit inside the circuit breaker may be improved and the lifespan of the circuit breaker may be prolonged.

Moreover, the closing resistor unit may more easily be attached to or detached from the fixed portion through the first supporting plate and the second supporting plate.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated. It is to be understood that the singular expression used in this specification includes the plural expression unless defined differently on the context.

Hereinafter, a supporting structure of a closing resistor unit for a circuit breaker according to one embodiment of the present invention will be described in detail with reference to the accompanying drawings.

Figure 1:
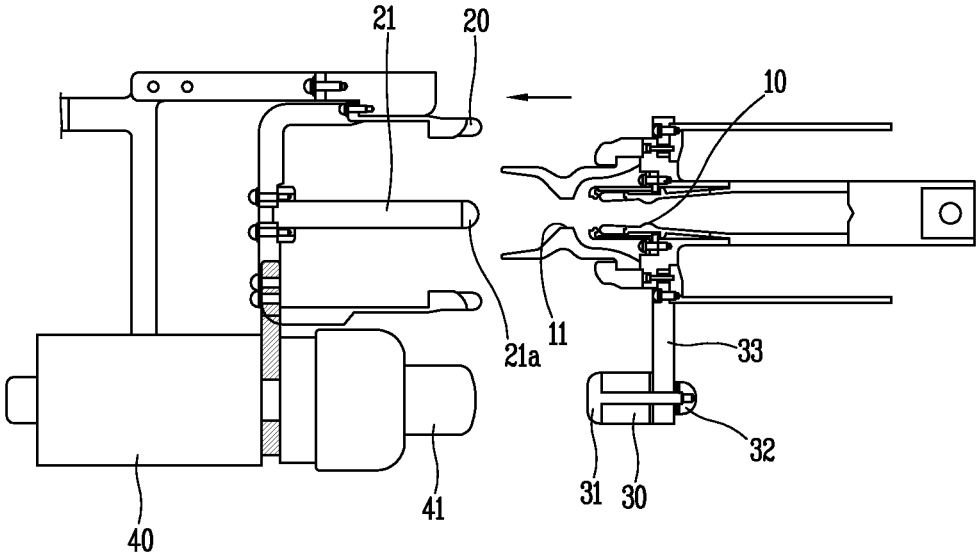
FIG. 1 RELATED ART
FIG. 1 is a schematic view showing the state that a moving portion and a fixed portion are detached from each other in a conventional circuit breaker.
Figure 2:
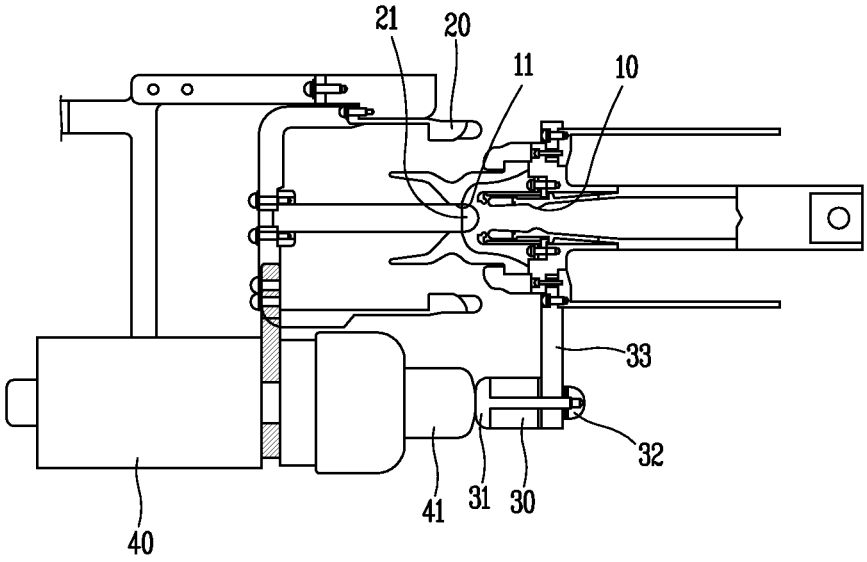
FIG. 2 RELATED ART
FIG. 2 is a schematic view showing the state that a moving portion and a fixed portion are in contact with each other in a conventional circuit breaker.
Figure 3:
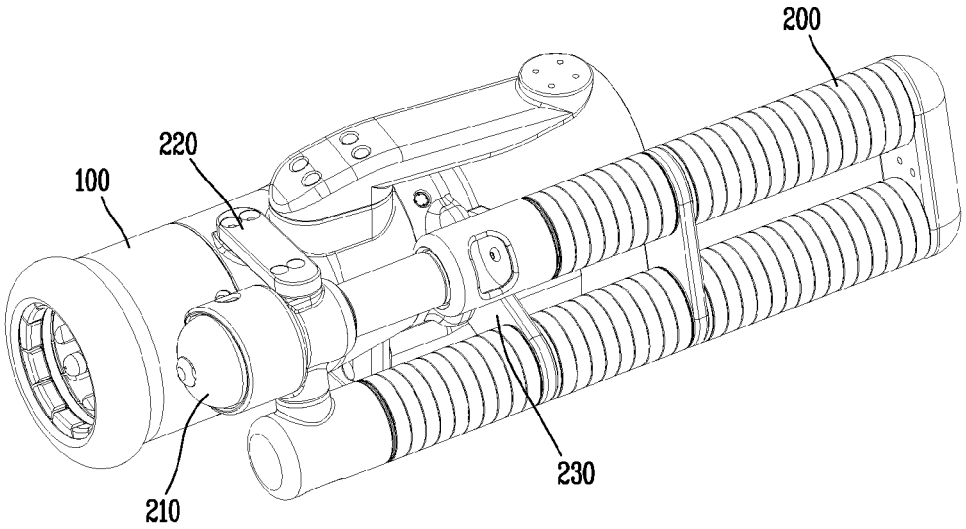
FIG. 3 is a perspective view showing the state that a closing resistor unit is installed in a fixed portion in accordance with the present invention.

FIG. 3 is a perspective view showing the state that a closing resistor unit is installed in a fixed portion in accordance with the present invention.

As shown in FIG. 3, the circuit breaker according to the present invention is provided with a moving portion (not shown) and a fixed portion 100 thereinside, and a closing resistor unit 200 is installed at the side of the fixed portion 100.

The closing resistor unit 200 is installed at the side of the fixed portion 100 in order to avoid the point of contact accident which occurs when the moving portion and the fixed portion 100 make contact.

The closing resistor unit 200 allows a closing resistor unit point of contact 210 provided in the closing resistor unit 200 to make contact with a closing resistor unit moving portion point of contact (not shown) before a main point of contact between the moving portion and the fixed portion 100 makes contact, whereby the moving portion and the fixed portion 100 makes contact in a state that overvoltage generated during the contact between the moving portion and the fixed portion 100 is suppressed at a predetermined level by the closing resistor unit 200.

Figure 4:
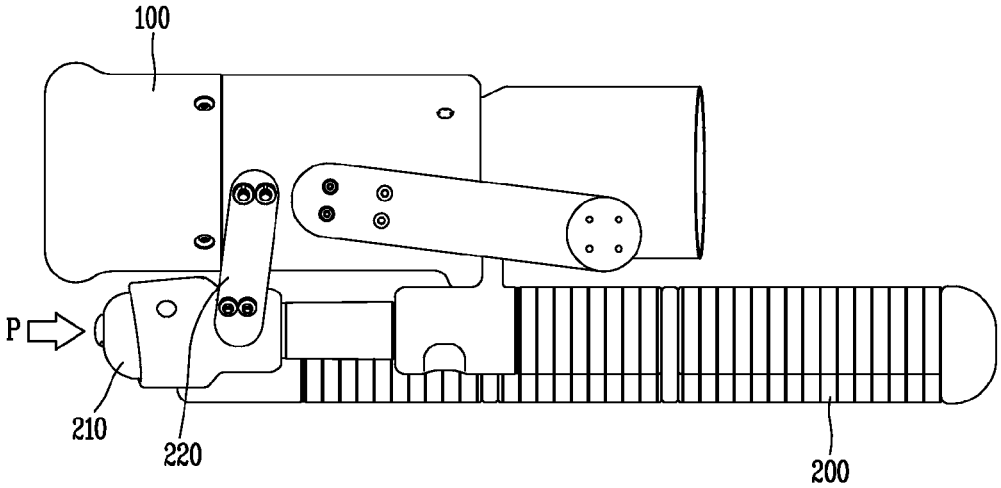
FIG. 4 is a plane view showing the state that a closing resistor unit is installed in a fixed portion in accordance with the present invention.
Figure 5:
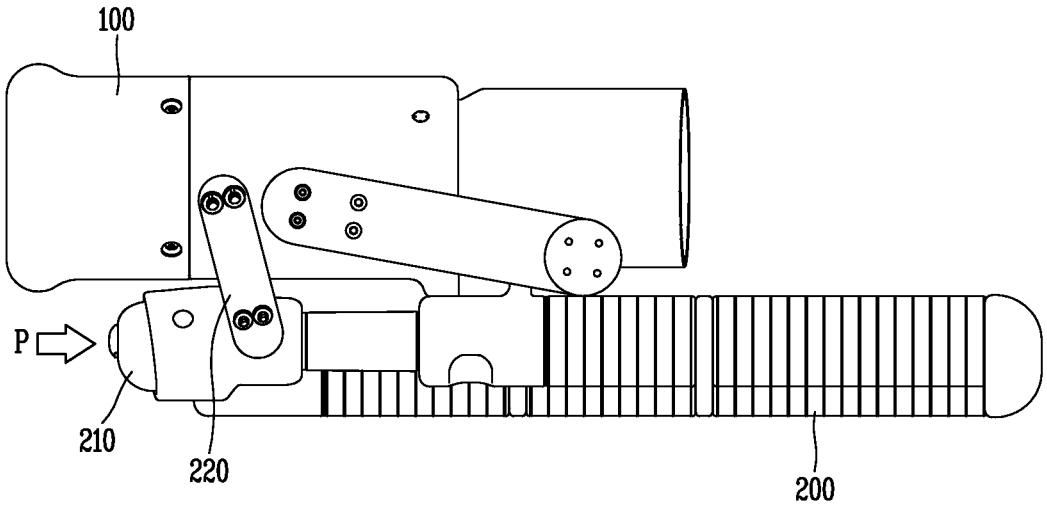
FIG. 5 is a plane view showing the state that a closing resistor unit installed in the fixed portion is moved backwards due to external impact in accordance with the present invention.
Figure 6:
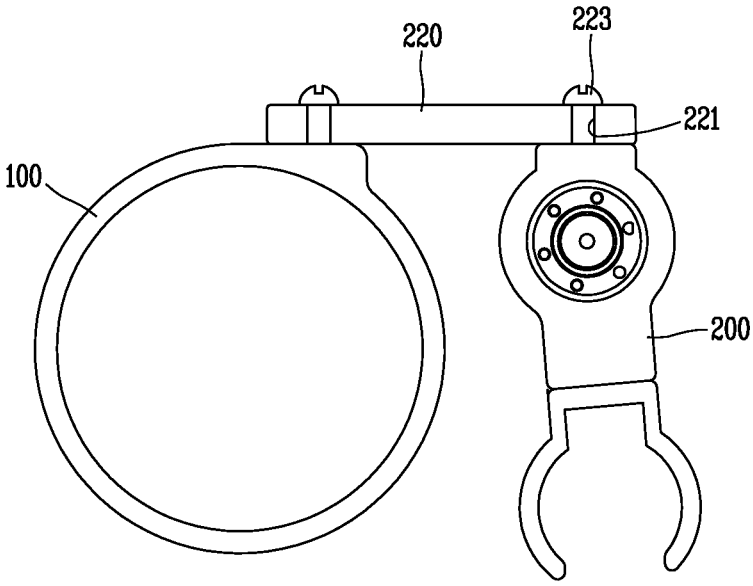
FIG. 6 is a cross-sectional view showing the state that a closing resistor unit is installed in a fixed portion in accordance with the present invention.
Figure 7:
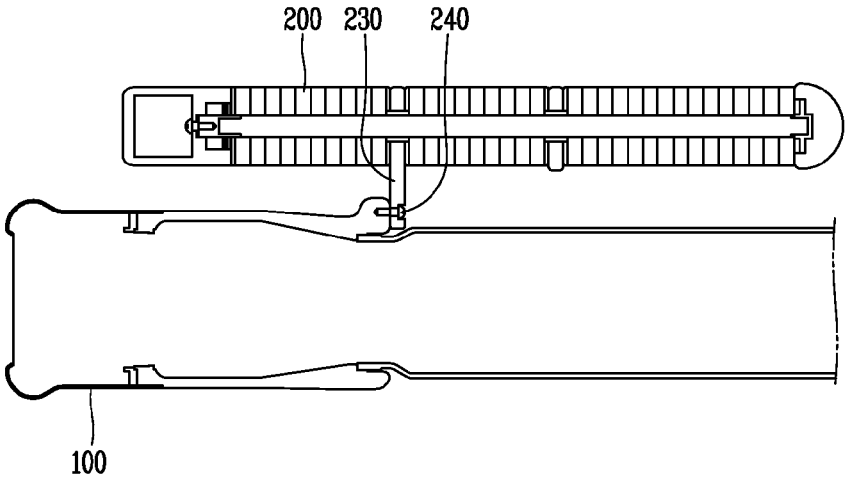
FIG. 7 is a plane perspective view showing the state that a closing resistor unit is installed in a fixed portion in accordance with the present invention.
Figure 8:
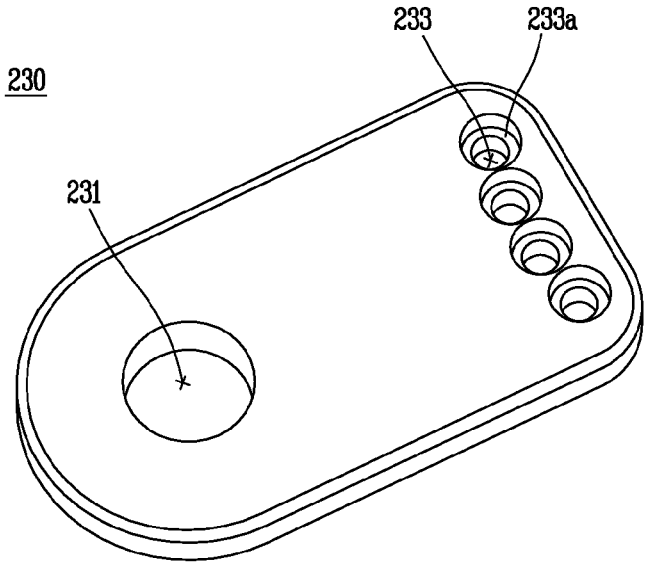
FIG. 8 is a perspective view showing a second supporting plate connected to a closing resistor unit of a circuit breaker according to the present invention.

FIG. 4 is a plane view showing the state that the closing resistor unit is installed in the fixed portion in accordance with the present invention, FIG. 5 is a plane view showing the state that a closing resistor unit installed in the fixed portion is moved backwards due to external impact in accordance with the present invention, FIG. 6 is a cross-sectional view showing the state that a closing resistor unit is installed in a fixed portion in accordance with the present invention, FIG. 7 is a plane perspective view showing the state that a closing resistor unit is installed in a fixed portion in accordance with the present invention, and FIG. 8 is a perspective view showing a second supporting plate connected to a closing resistor unit of a circuit breaker according to the present invention.

As shown in FIG. 4 to FIG. 8, a first supporting plate 220 is formed at a front upper end of the closing resistor unit 200, and a second supporting plate 230 is formed at the center of the closing resistor unit 200.

The first supporting plate 220 is rotatably connected to the front upper end of the closing resistor unit 200, and has one rotatably connected to the upper end of the fixed portion 100 at a predetermined angle front to back with respect to the fixed portion 100 and the other end rotatably connected to the upper end of the closing resistor unit 200 at a predetermined angle front to back with respect to the fixed portion 100.

At this time, one or more first supporting plate fastening holes 221 are formed at both sides of the first supporting plate 220, whereby a fastening member 223 such as a bolt is fastened onto the fixed portion 100 and the closing resistor unit 200 by passing through the first supporting plate fastening holes 221, allowing both ends of the first supporting plate 220 to rotate at a predetermined angle while connected to the fixed portion 100 and the closing resistor unit 200.

Therefore, if an external impact is given to the closing resistor unit 200, the closing resistor unit 200 may absorb the external impact by moving back and forth with respect to the fixed portion 100 through the first supporting plate 220.

Meanwhile, the second supporting plate 230 is provided at the center of the closing resistor unit 200 and allows the closing resistor unit 200 to move up and down with respect to the fixed portion 100.

At this time, a through hole 231 is formed at one end of the second supporting plate 230, and one or more second supporting plate fastening holes 233 are formed at the other end of the second supporting plate 230.

The closing resistor unit 200 is inserted into the through hole 231, and the fastening member 230 is fastened onto the fixed portion 100 by passing through the second supporting plate fastening hole 233.

Therefore, as the closing resistor unit 200 is inserted into the through hole 231, one end of the second supporting plate 230 is connected to the closing resistor unit 200. And, the other end of the second supporting plate 230 is connected to the fixed portion 100 rotatably at a predetermined angle after the fastening member 240 passes through the second supporting plate fastening hole 233. Then, when there is an external impact on the closing resistor unit 200, the other end of the second supporting plate 230 may absorb the impact by moving up and down with respect to the fixed portion 100 via the second supporting plate 230.

Moreover, the second supporting plate fastening hole 233 is further provided with a head seating portion 233*a* formed so that a head 241 of the fastening member 240 may be seated. When the fastening member 240 is fastened onto the fixed portion 100 by passing through the second supporting plate fastening hole 233, the head 241 is seated on the head seating portion 233*a*, making the head 241 not only unexposed to the outside but also connected to the fixed portion 100 through the second supporting plate fastening hole 233 more firmly.

The present invention not only allows the closing resistor unit 200 to absorb the impact generated by the contact between the closing resistor unit point of contact 210 and the closing resistor unit moving portion point of contact by moving back and forth through the first supporting plate 220, but also allows the closing resistor unit 200 to absorb impact by moving up and down through the second supporting plate 230, whereby the closing resistor unit 200 or the joints between the closing resistor unit 200 and the fixed portion 100 may be prevented from being damaged even by the external impact, ultimately improving the structural stability of the closing resistor unit 200.

Moreover, since the closing resistor unit 200 is firmly installed to the fixed portion 100, the circuit breaker may be used for a long period of time without worrying about detachment of the closing resistor unit 200 from the fixed portion 100, which extends the lifespan of the circuit breaker.

Moreover, since the closing resistor unit 200 is installed on the fixed portion 100 using the first and second supporting plates 220 and 230, the closing resistor unit 200 may more easily be attached to or detached from the fixed portion 100.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A supporting structure including a closing resistor unit for a circuit breaker, the closing resistor unit being connected to a fixed portion of the circuit breaker provided in a gas insulation switchgear (GIS) to prevent a point of contact accident between a moving portion and the fixed portion, the supporting structure comprising:

a first supporting plate connected at a front upper end of the closing resistor unit, having one end rotatably connected to an upper end of the fixed portion and another end rotatably connected to an upper end of the closing resistor unit; and a second supporting plate connected at a center of the closing resistor unit, having one end rotatably connected to a side of the fixed portion and another end connected to the closing resistor unit.

2. The supporting structure including the closing resistor for the circuit breaker of claim 1, wherein:

the first supporting plate is provided with one or more first supporting plate fastening holes formed at both sides, one end of the first supporting plate is rotated while connected to the fixed portion as a fastening member is fastened to the fixed portion and the closing resistor unit by passing through the first supporting plate fastening holes, and another end of the first supporting plate is rotated while connected to the closing resistor unit.

3. The supporting structure including a closing resistor unit for a circuit breaker of claim 1, wherein:

the second supporting plate is provided with a through hole formed at one end through which the closing resistor unit passes, one or more second supporting plate fastening holes formed at the other end of the second supporting plate, and the closing resistor unit is rotated by the second supporting plate as a fastening member is fastened to the fixed portion through the one or more second supporting plate fastening holes.

4. The supporting structure including the closing resistor for the circuit breaker of claim 3, wherein the fastening member is provided with a head formed at an upper portion, and the one or more second supporting plate fastening holes are further provided with a head seating portion on which the head is seated.

* * * * *